United States Patent [19]

Wirth et al.

[11] Patent Number: 4,958,491

[45] Date of Patent: Sep. 25, 1990

[54] ARRANGEMENT FOR HOLDING A CATALYST IN A HOUSING IN AN EXHAUST SYSTEM OF A LIQUID FUEL-OPERATED MOTOR

[75] Inventors: Georg Wirth, Kirchheim/Teck; Siegfried Wirth, Esslingen, both of Fed. Rep. of Germany

[73] Assignee: J. Eberspächer, Esslingen, Fed. Rep. of Germany

[21] Appl. No.: 174,121

[22] Filed: Mar. 28, 1988

[30] Foreign Application Priority Data

Mar. 28, 1987 [DE] Fed. Rep. of Germany ..... 3710299

[51] Int. Cl.[5] ..... F01N 3/28

[52] U.S. Cl. ..... 60/299; 422/179; 422/180

[58] Field of Search ..... 422/179, 180; 60/299

[56] References Cited

U.S. PATENT DOCUMENTS

| | | | |
|---|---|---|---|
| 4,335,077 | 6/1982 | Santiago | 422/179 |
| 4,343,074 | 8/1982 | Bailey | 422/179 |
| 4,448,754 | 5/1984 | Isogai | 422/179 |
| 4,782,661 | 11/1988 | Motley | 422/179 |

FOREIGN PATENT DOCUMENTS

| | | | |
|---|---|---|---|
| 1089769 | 11/1980 | Canada | 422/179 |

*Primary Examiner*—Douglas Hart

*Attorney, Agent, or Firm*—McGlew & Tuttle

[57] ABSTRACT

The holding of a catalytically-active monolith in a housing in the exhaust line of a liquid fuel-operated motor is done by a holder made of a knitting wrapped about a catalyst monolith. The knitting includes a segment with an undeformed thread area, where one or more sealing strips are accommodated, so that the holding qualities are improved with good prevention of a by-passing gas flow about the monolith, and the sealing strip is protected against abrasion and destruction and is securely retained in its position.

13 Claims, 2 Drawing Sheets

ARRANGEMENT FOR HOLDING A CATALYST IN A HOUSING IN AN EXHAUST SYSTEM OF A LIQUID FUEL-OPERATED MOTOR

FIELD AND BACKGROUND OF THE INVENTION

This invention relates in general to gas treatment devices and in particular to a new and useful construction for a catalyst converter system in an exhaust line of a liquid fuel operated motor.

The invention relates particularly to an arrangement for holding a catalyst in a housing in the exhaust system of a liquid fuel-operated motor and isolating the catalyst against a bypassing exhaust stream by an at least single-ply, corrugated metal knitting, surrounding the catalyst as a holder, which retains the catalyst in its installation position in the housing and which has at least one segment extending in the lengthwise direction of the holder to accommodate a sealing strip.

There are known arrangements in motor vehicles wherein catalytically coated monoliths are accommodated in a housing in the exhaust line of the motor vehicle motor. The monoliths to be retained are sensitive to impact and must be secured in their installation position Since the object to be retained has a coefficient of thermal expansion different from that of the pipeline or the receiving housing, special difficulties result. In the case of catalytically-coated monoliths for cleaning the exhaust gas in motor vehicles, it has been found advantageous to hold the monoliths by a peripheral knitting. This can be done by a knitting arranged at the front end and encompassing the end face of the object, or by mineral weaves arranged along the periphery and encompassing the end faces of the object (German patent No. 22 13 539). Finally, German AS No. 14 76 507 shows another monolith holder in which the surface of the object is covered with a pore-sealing layer of aluminum silicate, after which the holder proper is formed by a metal corrugated knitting. It is also known from German patent No. 22 13 539 that the retained object can be protected from the flow by arranging one or more radial sealing rings between the holder and the housing or the sealing impressions.

In these familiar devices there is a danger that the retained object may be moved by the pulsating process, changing its position and coming into contact with the parts of the housing, thereby becoming damaged. A second, related difficulty is the isolation of the exhaust gas flowing about the object. This stream must be kept as small as possible, since the gas flowing through the object is cleaned by virtue of flowing through the object, e.g. a catalyst, whereas the stream flowing about it remains untreated and rejoins the exhaust behind the catalyst, thus lowering the efficiency of the purification.

Therefore, an improved arrangement for holding a monolith in a housing in the exhaust line of a motor vehicle was disclosed in German OS No. 35 19 965, according to which the holder for the monoliths comprises a flat element of a compressed tubular metal knitting, having arrow-shaped impressions at a certain angle on either side and enveloping the monolith in at least a single ply, with at least one straight impression parallel to the lengthwise axis of this holder to accommodate a sealing strip. Although this arrangement represents a substantial improvement over the previously known layouts, it still has the serious disadvantages that the sealing strip rests on the compressed knitting and, thus, on a rough surface. Accordingly, under the thermal stress of the operating process, by virtue of the different expansions, the compressed knitting may rub against the sealing strip and by abrasion destroy the latter, resulting in loss of sealing action. Furthermore, the abraded matter escapes in the surrounding flow of exhaust gas, polluting the environment. Obviously, this also entails a reduction in lifetime of the exhaust cleaning system, even though enabling a longer working life of the catalytically active monolith.

SUMMARY OF THE INVENTION

The invention provides a holder which is easy to produce and install, being a mass produced article, in which the isolation of the bypassing flow of exhaust gas is achieved by simple means in a way that protects against destruction of the sealing element. In accordance with the invention, the metal threads of the knitting are not deformed in the segment of the holder accommodating the sealing strip, and at least one sealing strip is inserted in the thus-formed segment. The important fact of the invention is that there is no compressed knitting in the segment of the holder where the sealing strip is to be accommodated, but only smoothly, preferably parallel-lying metal threads, joining the adjacent portions of the knitting, whereby these threads are the same as those comprising the knitting. The segment extends in the lengthwise direction of the holder, the width of the holder roughly corresponding to the length of the catalytic monolith around which the holder is wrapped, in one or more plies. Thus, the sealing strip lies transverse to the direction of flow of exhaust gas around the monolith.

The holder may be a familiar knitted hose of metal threads, which is not fashioned as a knitting at the segment mentioned by the invention, but instead has straight threads, and is then compressed into a flat, two-ply element, whereby the non-knitted segments lie with their straight threads on each other and form the segment for accommodation of the sealing strip. Or the holder can be formed as a single-ply element of appropriate length, e.g. a length that is equal to or greater than twice the circumference of the monolith. In this case, the monolith is wrapped by the holder to produce a two-ply sheath.

To achieve an especially effective seal, a further characteristic of the invention is the fact that at least one sealing strip is introduced above and below or between the non-deformed metal threads of the knitting. For a flat single-ply holder that is wrapped about the monolith in one or two plies, the sealing strip prior to wrapping the monolith is inserted in the segment provided to contain it, being placed on or underneath the straight threads. For a holder made from a compressed tube the sealing strip can already be introduced into the segment provided when the tube is compressed, so that it will lie between the straight threads, and if necessary an additional sealing strip can be placed in the segment with the straight threads on the already introduced sealing strip prior to the wrapping around the monolith, so that after the wrapping of the monolith a double sealing strip is present. According to the invention, the thickness of the sealing strip is equal to or smaller than the height of the corrugation of the knitting at the sections adjoining the lodgement of the sealing strip.

With the holding of a monolith by the present invention, a reliable holding of the monolith is achieved by simple means, despite the different expansions of the monolith and the housing, and a stable seal against gas by-passing the monolith is accomplished, while the sealing strip is protected in simple manner against abrasion and destruction.

Accordingly, it is an object of the invention to provide a device for holding a monolith catalyst in an exhaust gas treatment device or housing which includes a housing which has a substantially cylindrical heated portion of larger diameter than both an inlet and outlet portion at respective ends and which includes a catalyst in an intermediate portion which is held by a holder formed of a knitted mass of metallic material which surrounds the catalyst and includes areas having obliquely defined deformed impressions at least adjacent the sides thereof and a portion with a sealing strip between the deformed areas which are not deformed.

A further object of the invention is to provide a holder for a catalyst which includes a knitted metallic mass which holds the catalyst in a central portion of a housing and has end portions which are turned around the edges of the catalyst with spaced apart side portions having depressions formed into the holder which extend obliquely downwardly toward the sides thereof and which includes a central strip area of non-deformed metal threads.

A further object of the invention is to provide a holder for a catalyst which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

BRIEF DESCRIPTION OF THE DRAWINGS

In the drawings:

FIG. 5 is a view of the knitting of FIG. 4 with the sides of the knitted tube turned in;

DESCRIPTION OF THE PREFERRED EMBODIMENTS

Figure 1:
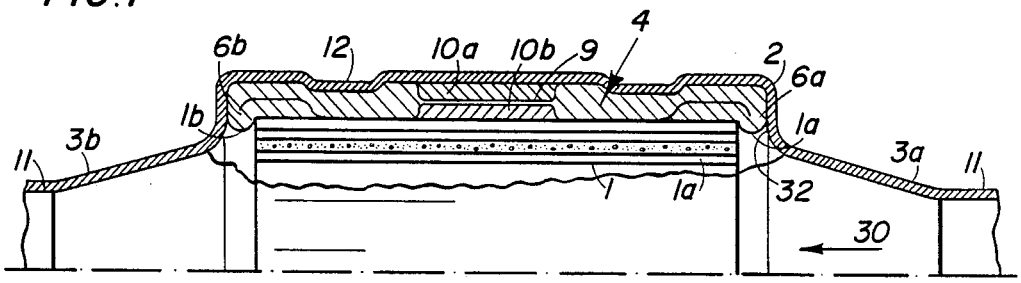
FIG. 1 is a schematic axial sectional view of a catalytic holder constructed in accordance with the invention.
Figure 2:
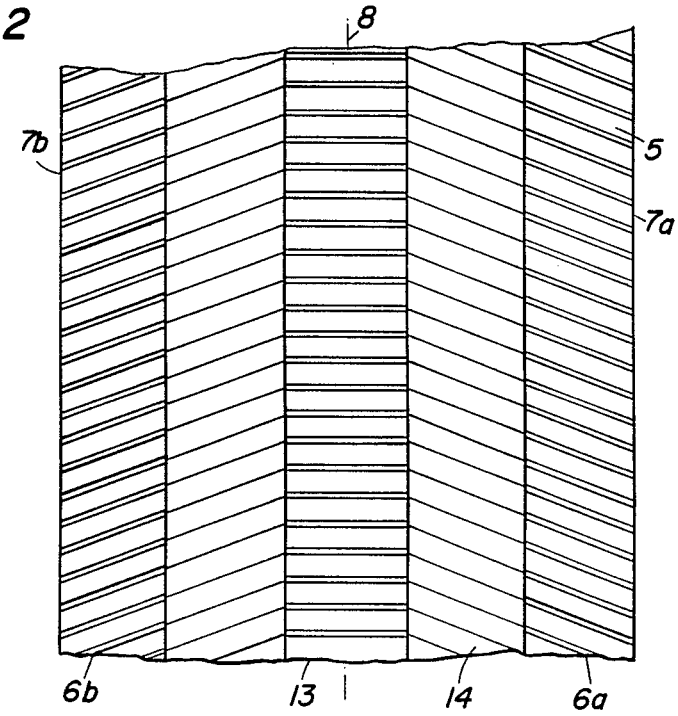
FIG. 2 is a developed view of the holder of FIG. 1.
Figure 3:
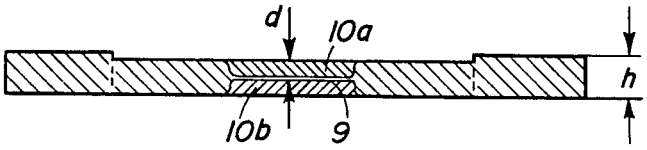
FIG. 3 is a transverse cross section of the holder of FIG. 1.
Figure 4:
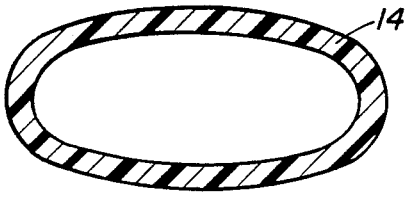
FIG. 4 is cross sectional view of another embodiment of the knitting as a tube portion 14.
Figure 5:
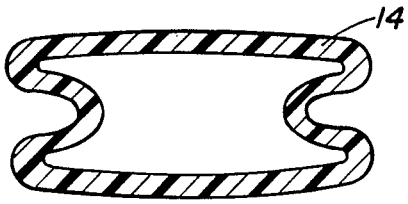

Referring to the drawings in particular, the invention embodied therein comprises a holder generally designated 4 for holding a catalyst which comprises a monolith 1 having axial extending tubular portions for the passage of an exhaust gas in which is engaged at respective ends by downturned areas 6*a* and 6*b* of the holding element 4.

In the sample configuration, an object 1, being a catalytically-coated monolith with a multitude of very small lengthwise channels 1*a*, is to be arranged and secured in a housing 2 arranged in a pipeline or passage 11, in the present instance, the exhaust line of a motor vehicle. Furthermore, the by-passing flow of exhaust about the object 1 should be prevented as much as possible and a holder in the housing 2 should be satisfactory under all operating conditions. Despite the different coefficients of expansion of the housing 2 (steel) and the object 1 (ceramic), the holder should be effective at the various prevailing temperatures, i.e. a range of around 800 to 900° C.

The exhaust line 11 has an inlet funnel 3*a* in the flow direction indicated by arrow 30, connected to the cylindrical housing 2 in which the object 1 is contained. The housing 2 can be connected to the inlet funnel 3*a* with a larger diameter, so that a guide edge 32 is formed. In a corresponding manner, the housing 2 is connected to an outlet funnel 3*b* with the subsequent pipeline or exhaust 11. The housing 2 is either welded to the two funnels 3*a*, 3*b*, or joined by flanges. The cylindrical housing 2 has exterior impressions 12 about the periphery, which extend either parallel to each other or in a spiral. These impressions 12 accomplish the pressing of a holder or holding element 4, which surrounds the object 1.

In accordance with the invention, the holder 4 comprises two-thread knitted tube 14, compressed into a flat element, of wire with a diameter of 0.23 mm, made from the material Inconel 601 of Inicrofer 6023, with a width of an area designated 14 of knitting 95 mm and a mesh of 60. On either side of the metal threads, the holder 4 has a plurality of embossed undulation that may be arrow-shaped (the undulations run at an angle relative to the lengthwise direction) or oblique impressions 5.

This produces a corrugation with a spacing of 10.5 mm for a height of knitting 6.5 mm (corrugation h), the arrow at either side expanding at 72° to the edge. At either margin or side area 6*a*, 6*b* there is a foldback at the outer lengthwise edges 7*a*, 7*b* of 18 mm, so that in these regions the number of plies is double. Furthermore, the holder 4 is provided with a segment 9 extending along a lengthwise axis 8, in which sealing strips 10*a* and 10*b* each of thickness d is inserted. In the installed condition, this lengthwise axis 8 extends at right angles to the direction of flow through the retained catalyst. In a central segment 9, the threads 13 of the knitting 14 lie in undeformed straight lines (non-interwoven), so that they form supporting bridges for the sealing strips 10*a* and 10*b* and assist in the retention of the sealing strip 10, since these "bridges" during use are impressed into the surface of the sealing strip 10. In cases of exceptional stress, the sealing strip 10 can also be interwoven with the straight threads 13 of the knitting 14, so that one thread 13 lies above and the next thread 13 below the combined sealing strip 10 of parts 10*a* and 10*b* each time. This achieves an especially good fixation of the position of the sealing strip 10 in the holder 4. A similar result is achieved with a tubular holder, subsequently compressed into a flat element see FIGS. 4–8, when the sealing strip 10 is embedded in the segment 9 provided to contain it prior to the compression. In this case, one layer of threads 13 lies on the sealing strip 10 and one layer underneath The segment 9 need not lie in the middle, as shown, but instead can be out of center, extending in the lengthwise direction of the holder 4, either parallel or oblique to the lengthwise direction.

The holder 4 is wider than the length of the object 1, so that when wrapped about the object 1, it extends onto the two end faces of same. After the assembly , these overextended segments lie on the individual end faces of the object I and form both an edge protection and a first barrier to the by-passing flow of exhaust. The arrow-shaped impressions 5 produce a better holding of the object 1 and prevent, in particular, a slanted displacement of the object 1. Furthermore, this measure intercepts the path of the exhaust gas flow and also provides a sealing action.

The so-called knitting 14 runs at an angle in relation to the longitudinal direction of the catalyzer or monolith 1.

In one embodiment the knitting 14 may be wound around the catalyzer 1 at least once and a sealing strip 10 is inserted subsequently from the outside into the seqment 9.

In the two marginal regions 6*a* and 6*b* of the holder a marginal turnover of the knitting 14 is provided.

Figure 6:
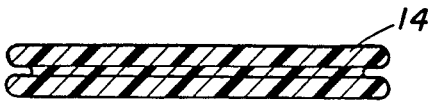
FIG. 6 is a view of the knitting of FIG. 5 pressed flat.

Also an embodiment may be such that the holder 4 comprises a hose-shaped knitting 14 which is compressed to a flat form as shown in FIG. 6.

Figure 7:
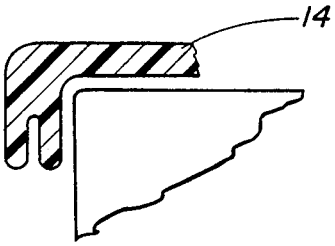
FIG. 7 is an arrangement of the knitted tube of FIG. 4, pressed flat and positioned; on the edge of the monolith.

A further arrangement or embodiment comprises two regions 6*a* and 6*b* of the holder 4, a hose or tubular shaped knitting 14 which is overturned so after compressing the areas of four layers of form as shown in FIG. 7.

While specific embodiments of the invention has been shown and described in detail to illustrate the application of the principles of the invention, it will be understood that the invention may be embodied otherwise without departing from such principles.

What is claimed is:

1. A device for holding a monolith catalyst in a housing, comprising a knitted mass of metallic material surrounding the catalyst, said knitted mass including areas of obliquely deformed impressions formed in said areas on each side of said mass and including a sealing strip portion between said deformed areas, said sealing strip portion being free of deformed impressions.

2. An arrangement according to claim 1, wherein a sealing strip is introduced into the segment above and below or between non-deformed metallic threads of said knitted mass.

3. An arrangement according to claim 1, wherein the thickness of the sealing strip portion is no greater than the height of the deformed impressions areas.

4. A device according to claim 1, wherein said housing includes an enlarged substantially cylindrical portion, an inlet and outlet portion connected to the respective ends of said cylindrical portion with the catalyst being arranged in said cylindrical portion in said holder, said holder being wider than the catalyst so that when wrapped around said catalyst it extends onto the end faces of the same and form edge protections for said catalyst, said obliquely deformed impressions being formed on each side of said strip portion and forming together a narrow shaped configuration slanting off from a central portion having strip providing means intercepting the path of the exhaust gas flow and a sealing action in respect to said housing. strip providing means intercepting the path of the exhaust gas flow and a sealing action in respect to said housing

5. A device according to claim 1, wherein said obliquely deformed impressions comprises knitting running in an angle in relationship to the longitudinal direction of said catalyzer.

6. A device according to claim 1, wherein said knitted mass wound around said catalyzer, a sealing strip covering a portion of said knitted mass.

7. A device according to claim 1, wherein said knitted mass includes a marginal area on each side of said knitted mass.

8. A device according to claim 1, wherein said knitted mass comprises a tubular member having indentations on each side thereof and being compressed flat.

9. A device according to claim 1, wherein said knitted mass comprises a tubular holder compressed to form a flat form.

10. A device according to claim 1, wherein said knitted mass comprises a tubular member which is folded upon itself on each marginal edge thereof and turned around an edge of said catalyst.

11. A monolith holding arrangement comprising:

a housing defining a monolith space with an inlet and an outlet defining a lengthwise flow path;

a monolith catalyst positioned in said housing monolith space;

a holding element with knitted portion with embossed undulations including a first knitted portion with undulations running at a first angle relative to the lengthwise direction of the housing and a second knitted portion with undulations running at a second angle relative to the direction of the housing and a sealing strip portion free of deformations positioned between said first and second knitted portions, said holding element being formed of a metallic material and surrounding said monolith catalyst.

12. A monolith holding arrangement according to claim 11, wherein said knitted portions are formed of interwoven metallic threads of said metallic material, said sealing strip portion being formed of parallel material threads extending from adjacent knitted portions.

13. A monolith holding arrangement according to claim 11, wherein said holding element is formed as a tubular section which is flattened such that a top portion and a bottom portion forming two layers surround said monolithic catalyst, said tubular section having a front and rear section pushed inwardly such that a front and rear section of said monolithic catalyst is surrounded by a doubled over top portion and a doubled over bottom portion forming four layers of the holding element at said front and rear section of said monolithic catalyst.

* * * * *

UNITED STATES PATENT AND TRADEMARK OFFICE

CERTIFICATE OF CORRECTION

PATENT NO. : 4,958,491

DATED : September 25, 1990

INVENTOR(S) : Wirth et al.

It is certified that error appears in the above-identified patent and that said Letters Patent is hereby corrected as shown below:

On the title page item [75] Inventors:
The inventors' names should be listed as
Georg Wirth and
Siegfried Wörner

Signed and Sealed this

Third Day of March, 1992

*Attest:*

HARRY F. MANBECK, JR.

*Attesting Officer*

*Commissioner of Patents and Trademarks*